US007000855B1

(12) United States Patent
Chen

(10) Patent No.: US 7,000,855 B1
(45) Date of Patent: Feb. 21, 2006

(54) WATERING PATTERN ADJUSTABLE MECHANISM FOR GARDEN NOZZLES

(75) Inventor: Yann-Shoou Chen, Hsinchu (TW)

(73) Assignee: Ho-Chin Chen, Taichung-Hsien (TW)

( * ) Notice: Subject to any disclaimer, the term of this patent is extended or adjusted under 35 U.S.C. 154(b) by 0 days.

(21) Appl. No.: 10/952,725

(22) Filed: Sep. 30, 2004

(51) Int. Cl.
*B05B 7/02* (2006.01)

(52) U.S. Cl. ..... 239/526; 239/456; 239/457; 239/458; 239/513; 239/525; 239/583; 239/586

(58) Field of Classification Search ..... 239/451, 239/456, 457, 458, 505, 513, 514, 518, 525, 239/526, 583, 586
See application file for complete search history.

(56) References Cited

U.S. PATENT DOCUMENTS 1,994,389 A * 3/1935 Frisco ..... 239/456
3,102,691 A * 9/1963 Gall ..... 239/456
5,333,792 A * 8/1994 Wang ..... 239/456
5,833,145 A * 11/1998 Smith ..... 239/526
6,427,931 B1 * 8/2002 Guo ..... 239/526

* cited by examiner

*Primary Examiner*—Steven J. Ganey
(74) *Attorney, Agent, or Firm*—Bacon & Thomas, PLLC

(57) ABSTRACT

A garden nozzle includes a core piece received in the barrel of the nozzle and the core piece includes an outlet allowing water to come out therefrom. The core piece is in communication with the path defined in the handle and water is provided via the path. A movable member is movably mounted to the core piece and is driven by an operation member connected to the barrel and can be operated by one finger of the user's hand grasping the handle. The position of the movable member changes the relative positions of the outlet and the opening located at a center of the cone-shaped inner periphery of the movable member, so as to obtain different pattern of watering.

6 Claims, 6 Drawing Sheets

WATERING PATTERN ADJUSTABLE MECHANISM FOR GARDEN NOZZLES

FIELD OF THE INVENTION

The present invention relates to a garden nozzle having an operation member located at an underside of the barrel and the operation member is rotated to move an adjusting member so as to obtain different patterns of watering.

BACKGROUND OF THE INVENTION

A conventional garden nozzle is disclosed in FIGS. 1 and 2, and generally includes a barrel 10 with a handle 11 through which a path 111 is defined. The handle 11 is connected with a hose which is not shown so that water enters the path 111 and comes out from the barrel 10. A rod 12 is movably extended into the barrel 10 from a rear end of the barrel 10 and a lever 15 is connected to the rod so as to pull the rod 12 backward to unseal an opening through which water in the chamber 112 in the barrel 10 is allowed to go through a pattern member 14 located at a front end of the barrel 10. A spring 121 is mounted to the rod 12 so as to provide a force to return the rod 12 after use. A nozzle member 13 is engaged with the barrel 10 and includes an outlet 131. The pattern member 14 is rotatably mounted to nozzle member 13. When the user wants to adjust the pattern of watering, he or she has to hold the handle 11 by one hand and rotate the pattern member 14 by the other hand. If the user rotates the pattern member 14 during watering, water stream hits the hand of the user and splashes the user.

The present invention intends to provide an adjustable mechanism that allows the user to use one finger of the hand holding the handle to adjust the way of watering.

SUMMARY OF THE INVENTION

The present invention relates to a garden nozzle which comprises a handle having a path defined therethrough and a barrel is connected to a top of the handle. A trigger is pivotably connected to the handle for controlling the path and a core piece is received in the chamber in the barrel. The core piece has an outlet defined radially in a front end thereof and a threaded section is defined in an outer periphery thereof. A movable member is movably mounted to the core piece and has a threaded inner periphery which is engaged with the threaded section of the core piece. The movable member has a threaded outer periphery and an opening is defined through a front end thereof. An adjustable mechanism including an operation member rotatably engaged with the barrel and a driving member in the barrel is driven by the operation member. The driving member is threadedly engaged with the threaded outer periphery of the movable member such that a position of the opening of the movable member is movable relative the outlet of the core piece.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
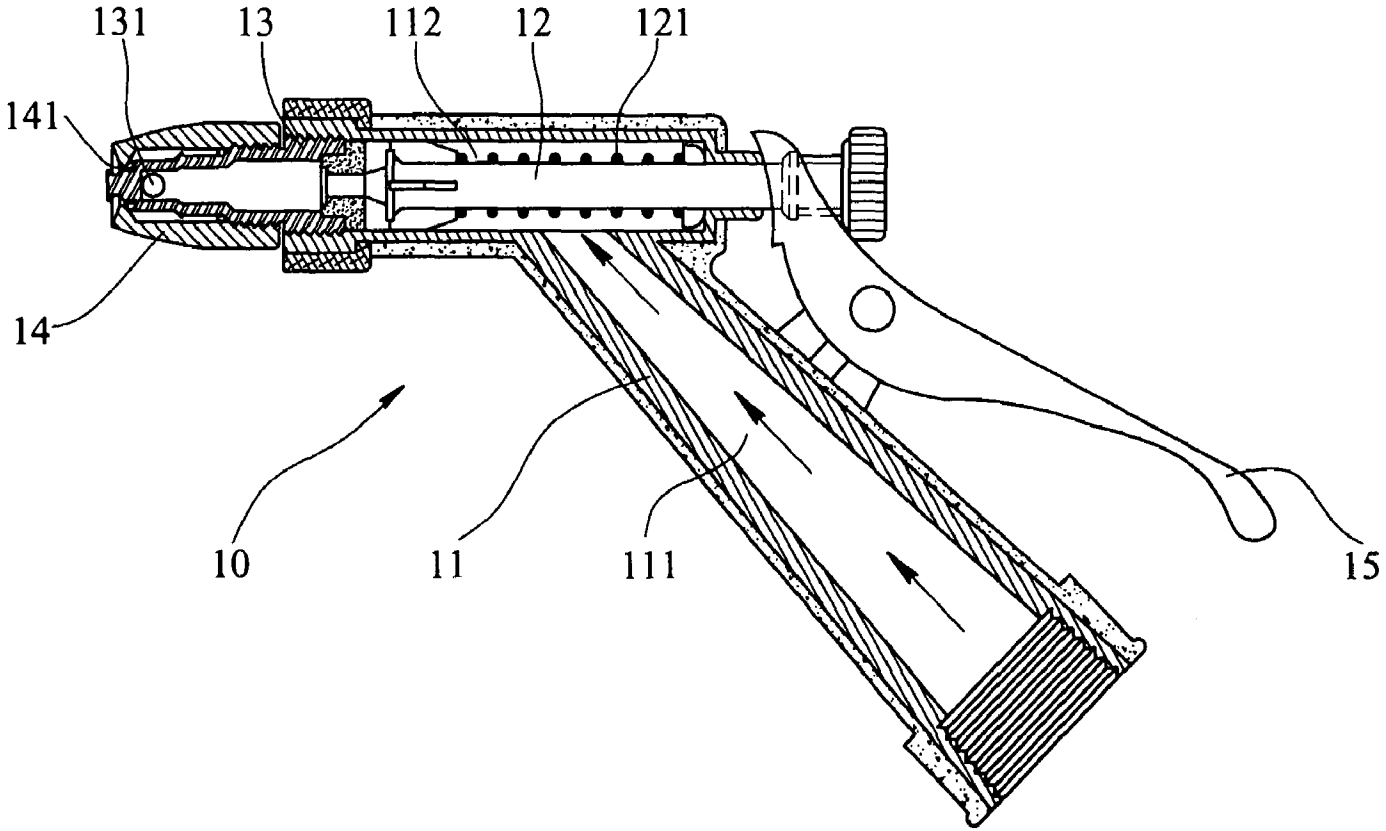
FIG.1 PRIOR ART
FIG. 1 is a cross sectional view to show a conventional garden nozzle.
Figure 2:
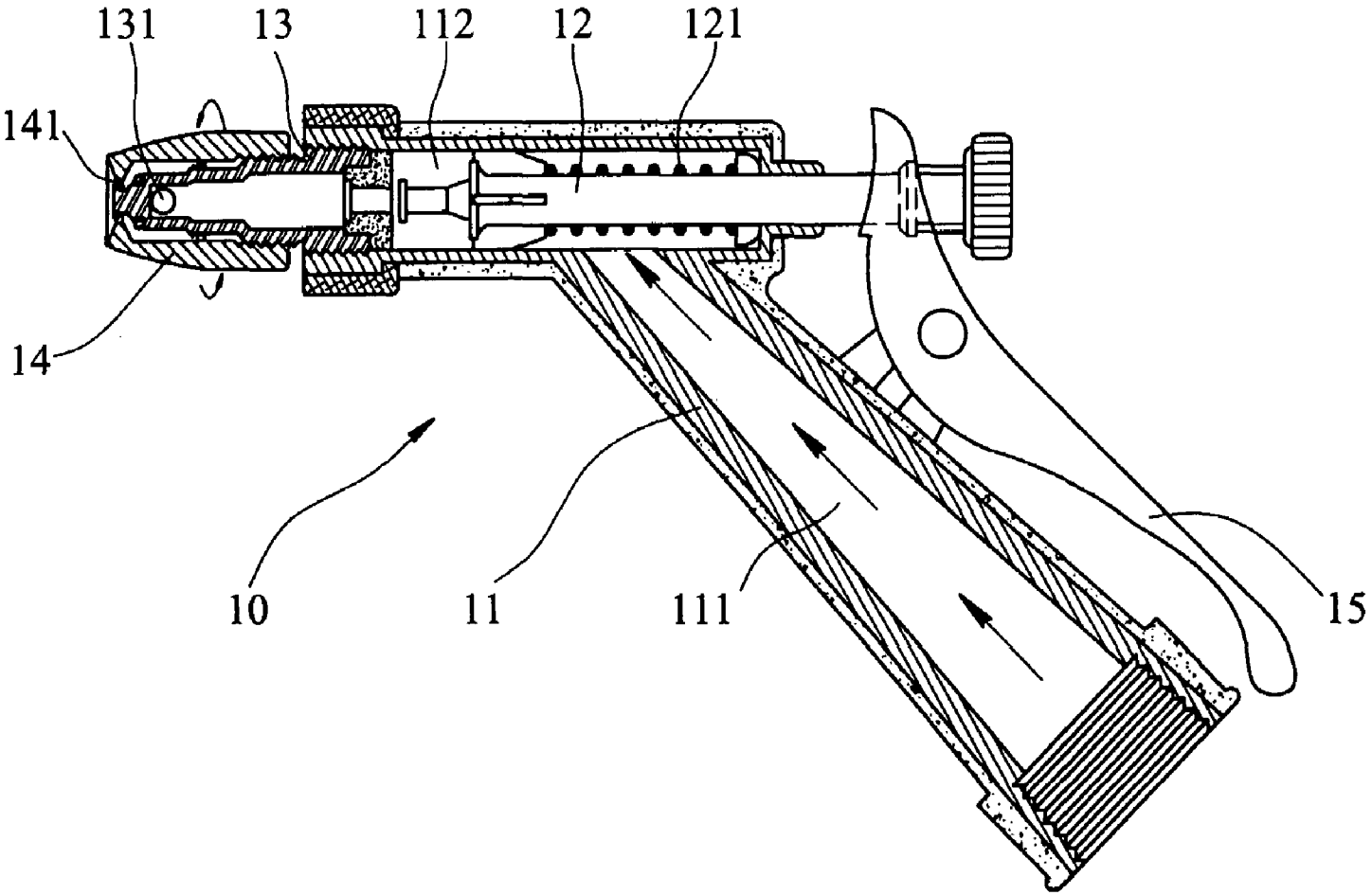
FIG.2 PRIOR ART
FIG. 2 shows that the rod of the conventional garden nozzle is pulled such that water is allowed to go out from the nozzle member.
Figure 3:
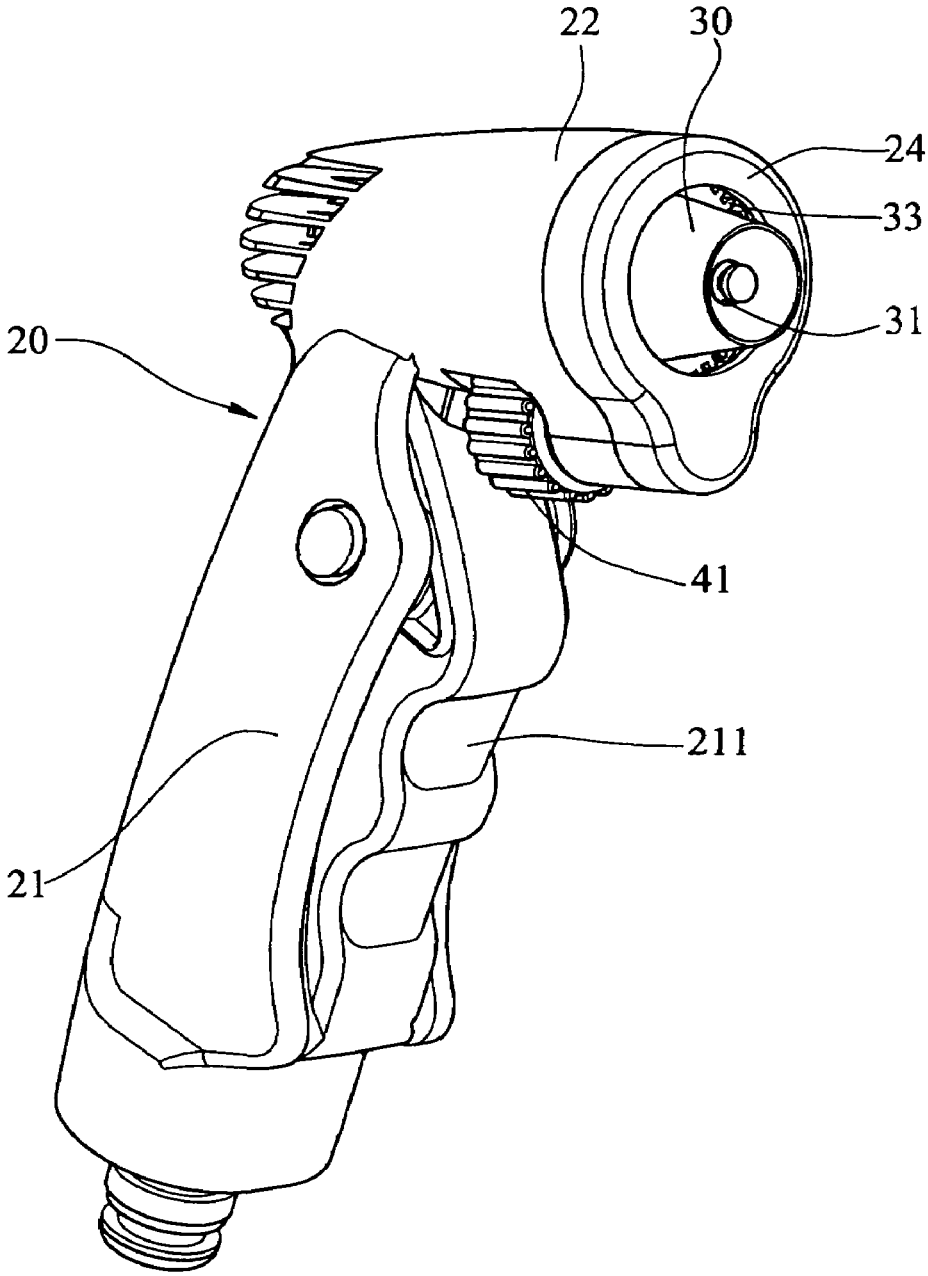
FIG. 3 is a perspective view to show the garden nozzle of the present invention.
Figure 4:
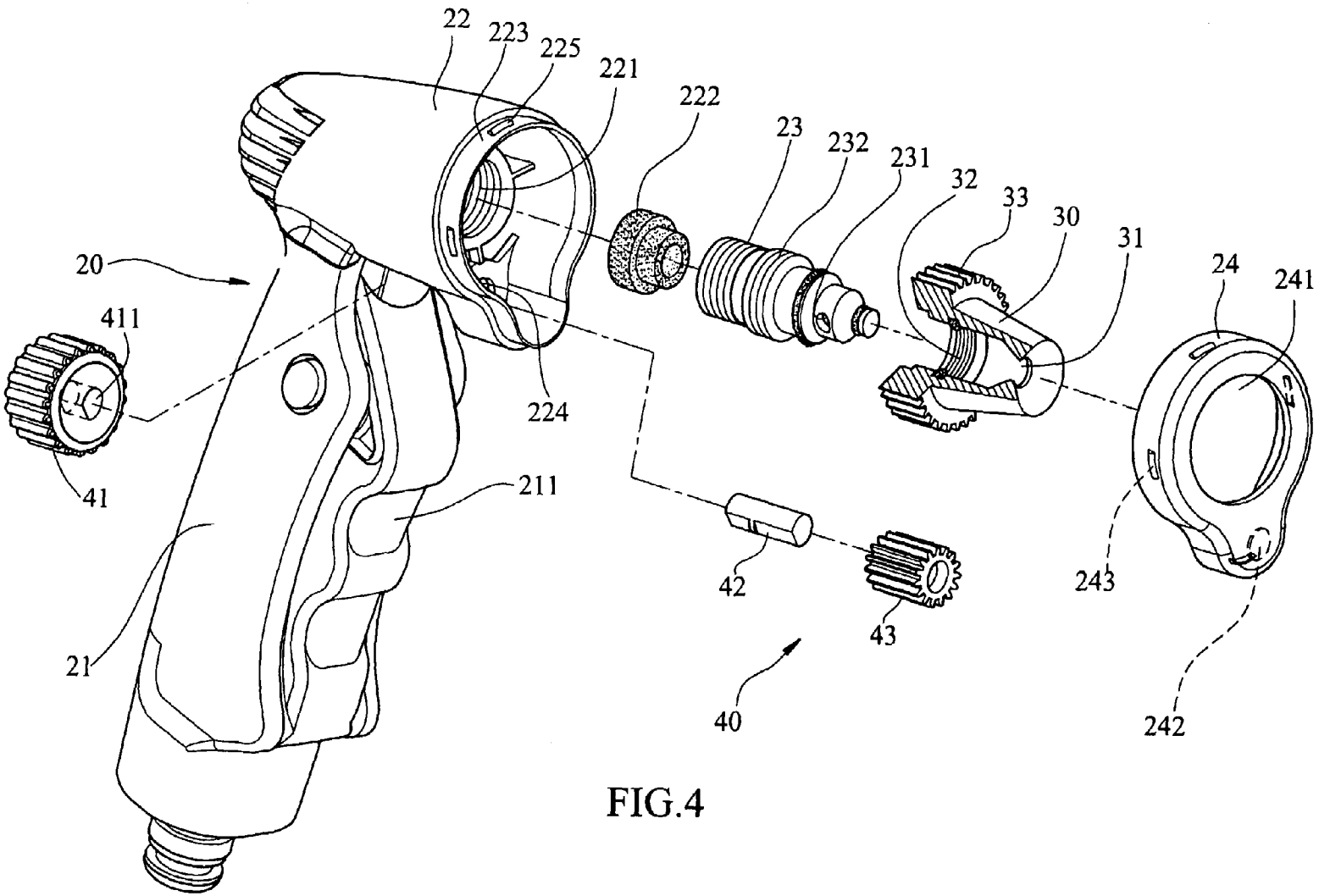
FIG. 4 is an exploded view to show the garden nozzle of the present invention.
Figure 5:
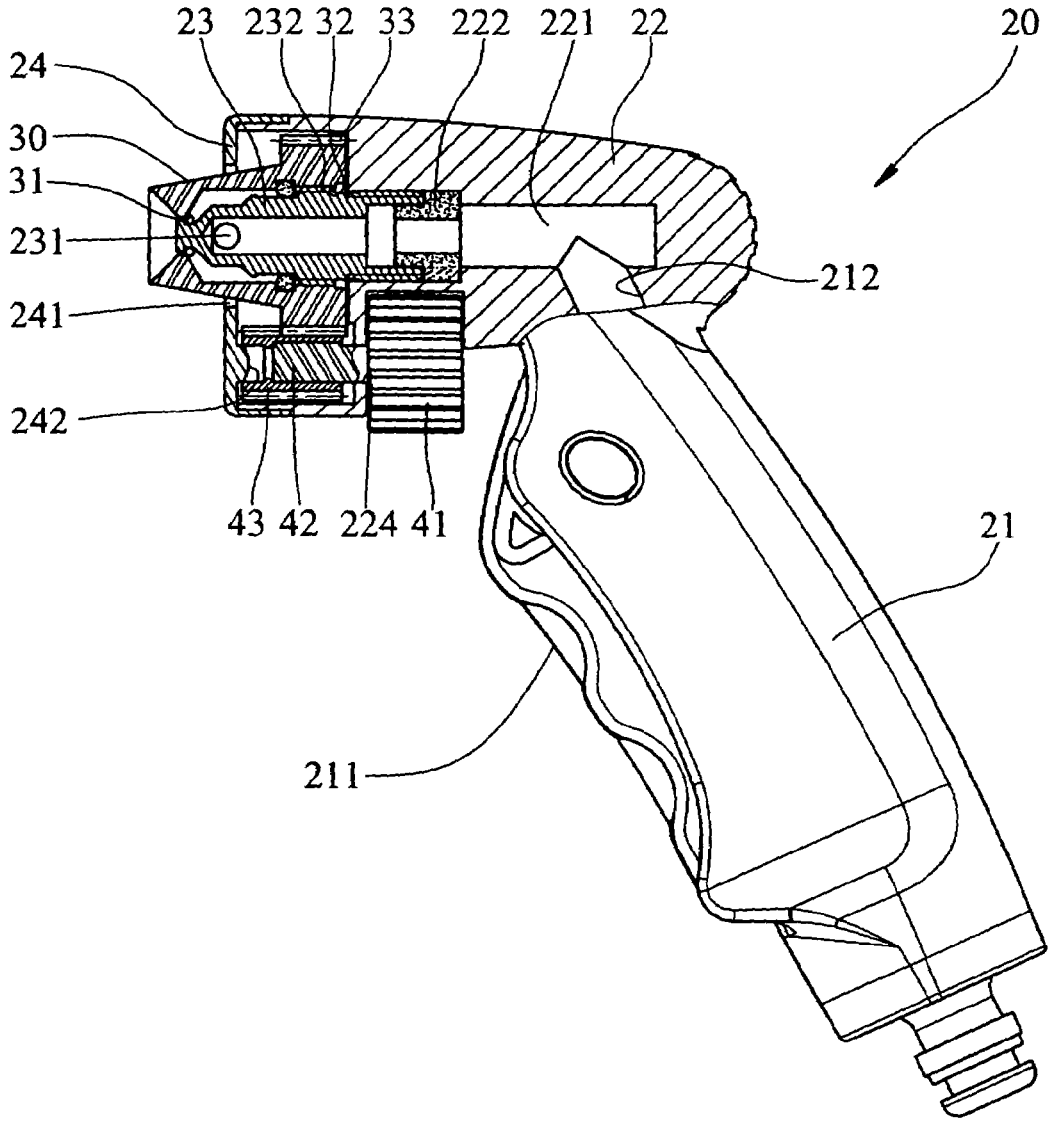
FIG. 5 is a cross sectional view to show the garden nozzle of the present invention.

Referring to FIGS. 3 to 5, the garden nozzle 20 of the present invention comprises a handle 21 having a path 212 defined therethrough and a connection fitting is connected to a bottom of the handle 21 so as to be connected to a hose which is not shown and water enters into the path 212 via the hose. A barrel 22 is connected to a top of the handle 21 and a trigger 211 is pivotably connected to the handle 21 so as to control the path 212 in the handle 21. A chamber 221 is defined in the barrel 22 and opens to a front open end of the barrel 22 and in communication with the path 212. A lip 223 extends from the front open end of the barrel 22 and includes a plurality of blocks 225 extending from an outer periphery thereof. A seal 222 is engaged with the chamber 221 and a core piece 23 has one end connected to the seal 222. The core piece 23 is threadedly received in the chamber 221 and has an outlet 231 defined radially in a front end thereof. The core piece 23 includes a threaded section 232.

A movable member 30 is movably mounted to the core piece 23 and has a threaded inner periphery 32 which is engaged with the threaded section 232 of the core piece 23. The movable member 30 has a threaded outer periphery 33 and a cone-shaped protrusion extends therefrom which includes a cone-shaped inner periphery. An opening 31 is located at a center of the cone-shaped inner periphery and the front end with the outlet 231 of the core piece 23 is located in the cone-shaped protrusion.

An adjustable mechanism 40 includes an operation member 41 which is rotatably engaged with the barrel 22 and is accessible from outside of the barrel 22. The operation member 41 includes a shaft 42 fixed to a receiving recess 411 in a center of the operation member 41 and the shaft 42 rotatably extends through an aperture 224 defined in a rib in the barrel 22. A driving member 43 is connected to the shaft 42 so that the driving member 43 is rotated with the operation member 41. The driving member 43 threadedly engaged with the threaded outer periphery 33 of the movable member 30.

A cap 24 is connected to the front open end of the barrel 22 and includes a hole 241 through which the cone-shaped protrusion of the movable member 30 extends. The cap 24 having a peripheral wall which has slots 243 defined therein so that the blocks 225 are engaged with the slots 243 and a positioning protrusion 242 extends from an inside of the cap 24. The positioning protrusion 242 is engaged with an end of the driving member 43.

Figure 6:
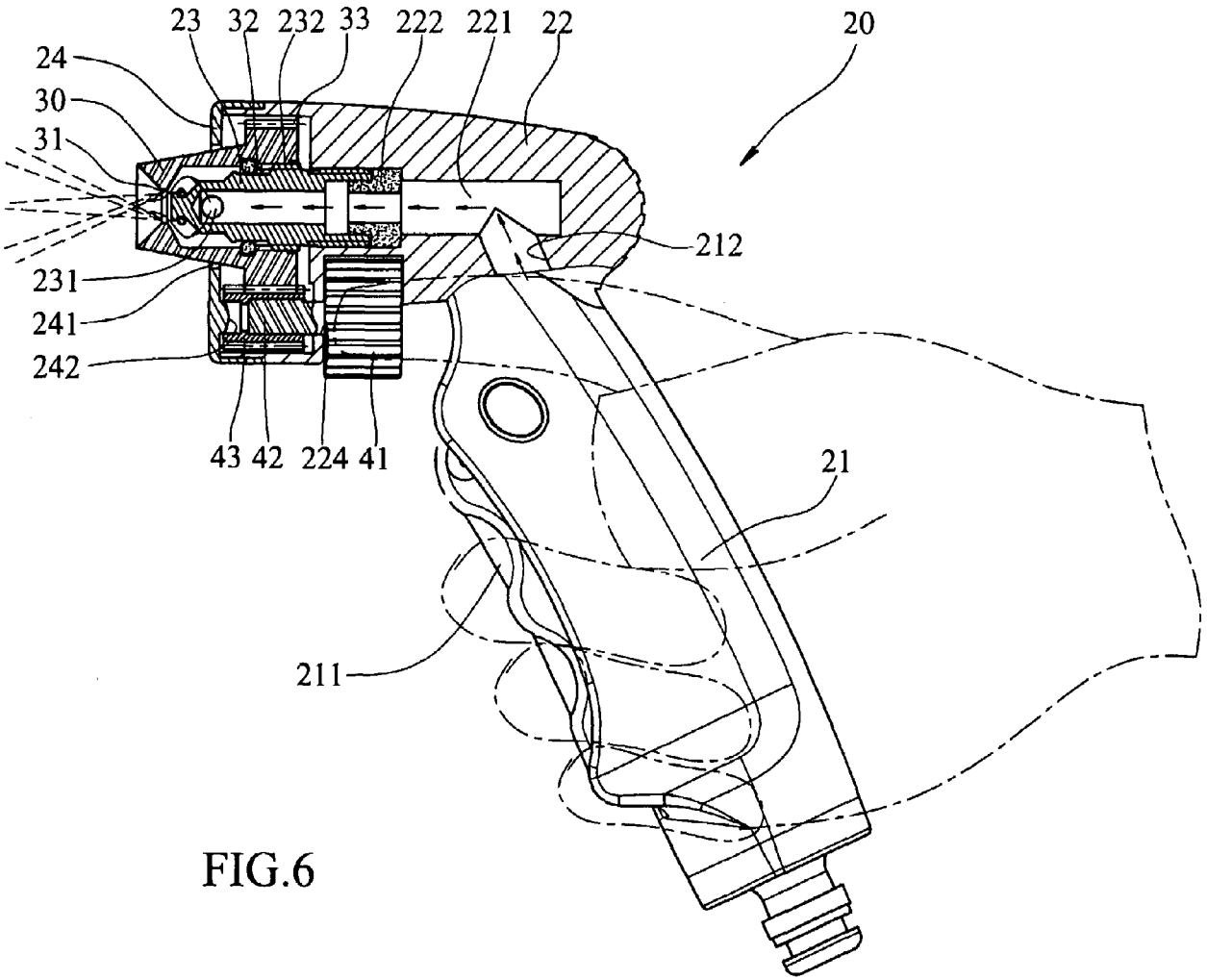
FIG. 6 shows the trigger is pulled and water goes out from the movable member.

As shown in FIG. 6, when pulling the trigger 211, water enters the chamber 221 in the barrel 22 and goes out from the outlet 231 of the core piece 23 and the opening 31 of the movable member 30. The user may rotate the operation member 41 by one finger of the hand holding the handle 21. The movable member 30 is driven by the driving member 43 and moved relative to the core piece 23. A position of the opening 31 of the movable member 30 is movable relative to outlet 231 of the core piece 23 such that the distance from the outlet 231 to the cone-shaped inner periphery of the movable member 30 is changed so as to change the watering pattern.

While we have shown and described the embodiment in accordance with the present invention, it should be clear to those skilled in the art that further embodiments may be made without departing from the scope of the present invention.

What is claimed is:

1. A garden nozzle comprising:

a handle having a path defined therethrough and a barrel connected to a top of the handle, a trigger pivotably connected to the handle, a chamber defined in the barrel and opening to a front open end of the barrel;

a core piece received in the chamber and having an outlet defined radially in a front end thereof, the core piece including a threaded section;

a movable member movably mounted to the core piece and having a threaded inner periphery which is engaged with the threaded section of the core piece, the movable member having a threaded outer periphery and an opening defined through a front end thereof, and an adjustable mechanism including an operation member which is rotatably engaged with the barrel and being accessible from outside of the barrel, a driving member received in the barrel and driven by the operation member, the driving member threadedly engaged with the threaded outer periphery of the movable member such that a position of the opening of the movable member is movable relative to the outlet of the core piece.

2. The nozzle as claimed in claim 1, wherein the movable member has a cone-shaped inner periphery and the opening is located at a center of the cone-shaped inner periphery.

3. The nozzle as claimed in claim 1, wherein a cap is connected to the front open end of the barrel and includes a hole through which the movable member extends.

4. The nozzle as claimed in claim 3, wherein a lip extends from the front open end of the barrel and includes a plurality of blocks extending from an outer periphery thereof, the cap having a peripheral wall which has slots defined therein so that the blocks are engaged with the slots.

5. The nozzle as claimed in claim 1, wherein the operation member includes a shaft fixed to a center thereof and the shaft rotatably extends through an aperture defined in a rib in the barrel, the driving member is connected to the shaft.

6. The nozzle as claimed in claim 3 further comprising a positioning protrusion extending from an inside of the cap and engaged with an end of the driving member.

* * * * *